United States Patent [19]

Elliott, Jr. et al.

[11] 4,039,854

[45] Aug. 2, 1977

[54] LIQUID RHEOSTAT SYSTEM

[75] Inventors: Richard Louis Elliott, Jr.; William John Borkowski; Thomas Warren Pfister, all of Baltimore, Md.

[73] Assignee: Maryland Shipbuilding & Drydock Company, Baltimore, Md.

[21] Appl. No.: 677,717

[22] Filed: Apr. 16, 1976

[51] Int. Cl.[2] ..... H01C 1/082

[52] U.S. Cl. ..... 307/118; 338/56; 333/22 F; 307/117

[58] Field of Search ..... 307/117, 118; 338/55, 338/56, 80, 94, 86, 139, 222; 324/158 MG, 95; 333/22 F; 322/99

[56] References Cited

U.S. PATENT DOCUMENTS

| | | | |
|---|---|---|---|
| 1,086,109 | 2/1914 | Wilkinson | 338/56 |
| 1,161,993 | 11/1915 | Steen | 338/86 |
| 1,253,235 | 1/1918 | Hall | 338/86 |
| 1,939,902 | 12/1933 | Kaul | 338/139 |
| 2,868,932 | 1/1959 | Schonhoff et al. | 338/56 |

*Primary Examiner*—Robert K. Schaefer
*Assistant Examiner*—Morris Ginsburg
*Attorney, Agent, or Firm*—J. Gibson Semmes

[57] ABSTRACT

Liquid rheostat system especially a water rheostat, employing the principle wherein electrical energy may be dissipated in the form of heat, by passing the electrical current through a liquid resistor or electrolyte, and wherein the apparatus is reasonably portable, inexpensive, and economical to operate and maintain. The invention readily compensates in use for variations in respective resistivity of fresh and/or brackish waters in a test mixture whereby to provide sufficient initial resistance as well as an adequate range of control of resistance, while maintaining current density within the desired limits. In use the heat energy developed is absorbed and removed by the controllable water mixture which in operation of the rheostat system continuously flows out of the rheostat. This is accomplished in part by shaping electrode plates to increase the immersed area thereof, with preselected disposition of intermediate dielectric plates, so shaped as to decrease the length of the current path developed in the apparatus as the liquid level therein may be caused to rise as required during operation of the system.

15 Claims, 5 Drawing Figures

LIQUID RHEOSTAT SYSTEM

BACKGROUND OF THE INVENTION

This invention constitutes an improvement invention over U.S. Pat. No. 2,868,932, dated Jan. 13, 1959 and entitled DUMMY LOAD RESISTOR, one of the inventors of said patent being co-inventor herein.

BRIEF DESCRITPION OF THE PRIOR ART

A. Liquid-water rheostats have long been widely used as a secondary or rotary resistance for speed control of large wound rotor induction motors and as unity power factor test load for small and medium sized generating plants up to, for example, approximately 10,000 K.W.

B. The liquid rheostat employs the principle that electrical energy may be dissipated in the form of heat, by passing the electrical current encountered through a liquid resistor or electrolyte.

To accomplish this, two or more electrodes are immeresed in the electrolyte the current path.

C. The majority of liquid rheostats vary the length of the current path through the liquid between the electrodes while effective cross-sectional area of current in liquid path (immersed area of elecrode) and the resistivity of the liquid in ohms are maintained as constant as possible by metered addition of conductive salts to the electrolyte and circulation of the electrolyte through a cooling tower to maintain a fairly constant temperature. A number of liquid rheostats vary the effective cross-sectional area of the liquid between electrodes by controlling the liquid height or immersion depth of the electrodes while attempting to keep the length of the current path through the liquid between the electrodes and the resistivity in ohms constant.

The most common problems encountered in the operation of liquid rheostats have been:

a. Insufficient temperature control of electrolyte resulting in changing resistivity. The resistivity of the liquids have negative temperature coefficients and consequently, if temperature is not controlled, can easily reach the boiling point of te electrolyte with resultant instability and danger of flash over. In order to maintain a relatively constant electrolyte temperature, sufficient flow of electrolyte through the electrodes must be maintaind to dissipate the electrical energy absorbed in the rheostat in the form of heat.

b. Local "hot spots" due to uneven flow of electrolyte or unequal current paths. This can result in localized boiling, unbalanced currents and danger of flashover.

c. Electrolysis and corrosion in direct current applications.

d. Limited range of resistance in many designs.

Rheostats employed as starting resistors for direct current motors or other intermittent, short-time applications may depend on the volume of liquid within the enclosure, without continuous input and discharge, to dissipate the thermal energy. The high specific heat and heat of vaporization of water are helpful in this respect. Only liquid lost by evaportion requires make-up for these applications.

Liquid rheostats used as secondary circuit resistance for speed control of wound rotor induction motors and as electrical load absorption units for generator tests, etc. where energy must be converted and dissipated for relatively long time periods generally require either: infinite volume of electrolyte (as in the type where electrode grids are dipped into very large tanks or natural bodies of water), the use of heat exchanging coils in the tank through which cooling water is circulated, or a continuous flow of a sufficient volume of electrolyte to maintain relatively constant temperature or a purposely controlled rate of temperature rise.

Aside from the aforementioned Schonhoff et al U.S. Pat. No. 2,868,932, the best present existing patented art comprises Steen U.S. Pat. No. 1,161,993, Hall U.S. Pat. No. 1,253,235 and Kaul U.S. Pat. 1,939,902. The former two patents relate to mechanical means for effecting liquid rheostat contrl, whreas the Kaul patent, while related, discloses the concept of achieving variable resistance by proportional coating. The essence of the present invention resides in the combination of shaping electrode plates for desired increases in area versus increases in height of electrolyte, with preselected disposition of intermediate dielectric plates, shaped especially to decrease length of the current path through the apparatus as the liquid level therein may be caused to rise.

Coastal shipyards have heretofore generally employed water rheostats as a load using the method of varying immersed electrode area, to accomplish generating plant voltage regulation and temperature rise versus load testing.

The earlier patented system disclosed in U.S. Pat. No. 2,868,932 has performed well over the years. However, where fresh and/or raw (brackish) water resistivity varies considerably from the values for which the standard unit is designed, rather extensive redesign of the unit is required in order to provide the proper initial resistance, as well as an adequate range of control of resistance, while maintaining current density within the desired limits. The more critical and common problem is very low resistivity of fresh water at the operation site in some geographical locations.

THE INVENTION

In the present invention the addition of intermediate barrier plates constructed of dielectric material and shaped to gradually decrease the length of the current path through the electrolyte as liquid level in the tank rises improves the resistance versus liquid height characteristic so that it is linear over most of the range of liquid height. Where further adjustment of resistance versus liquid height characteristic is desired, the electrode plates are shaped so that the rate of change of immersed electrode area, in addition to the barrier configuration, produces the desired resistance versus liquid height characteristic.

Where the duration of operation at some liquid level less than normal overflow height is sufficient to convert enough electrical energy to heat to exceed desired liquid temperature range, there is provided herein a weir system, which is self adjustable in increments and designed to provide sufficient flow of liquid at intermediate heights to prevent excessive increases in temperature.

The weir system consists of apertures through the sides of the box through which the liquid can discharge at several intermediate levels into the trough, and a weir at the discharge end of each side trough. The number and size of the apertures, and the size and shape of the trough weirs, are dependent on the desired rate of flow at each intermediate liquid height which in turn depends upon the particular load dissipation requirements of each rheostat.

The present invention including structure and operation will be more apparent from the following detailed description of embodiments thereof. The description and drawings include only such material and disclosure as required for one skilled in the art to place the invention in practice bearing in mind that overall operation is quite clearly shown and described in the preceding Schonhoff et al U.S. Pat. No. 2,868,932.

Reference is herein made to the aforementioned Schonhoff et al patent and the disclosure thereof is incorporated herein by reference thereto.

For a further complete understanding of the invention reference is made to the accompanying drawings in which.

Figure 4B:
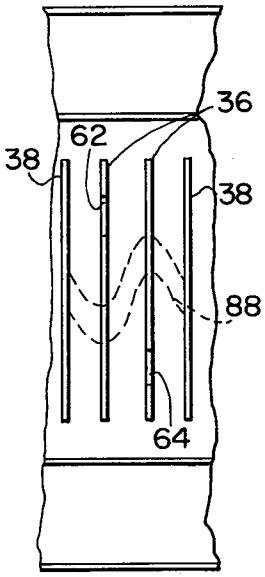
Figure 4A:
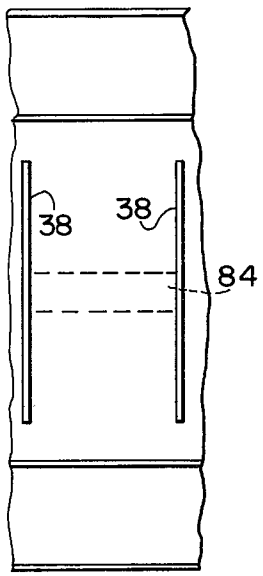
Figure 3:
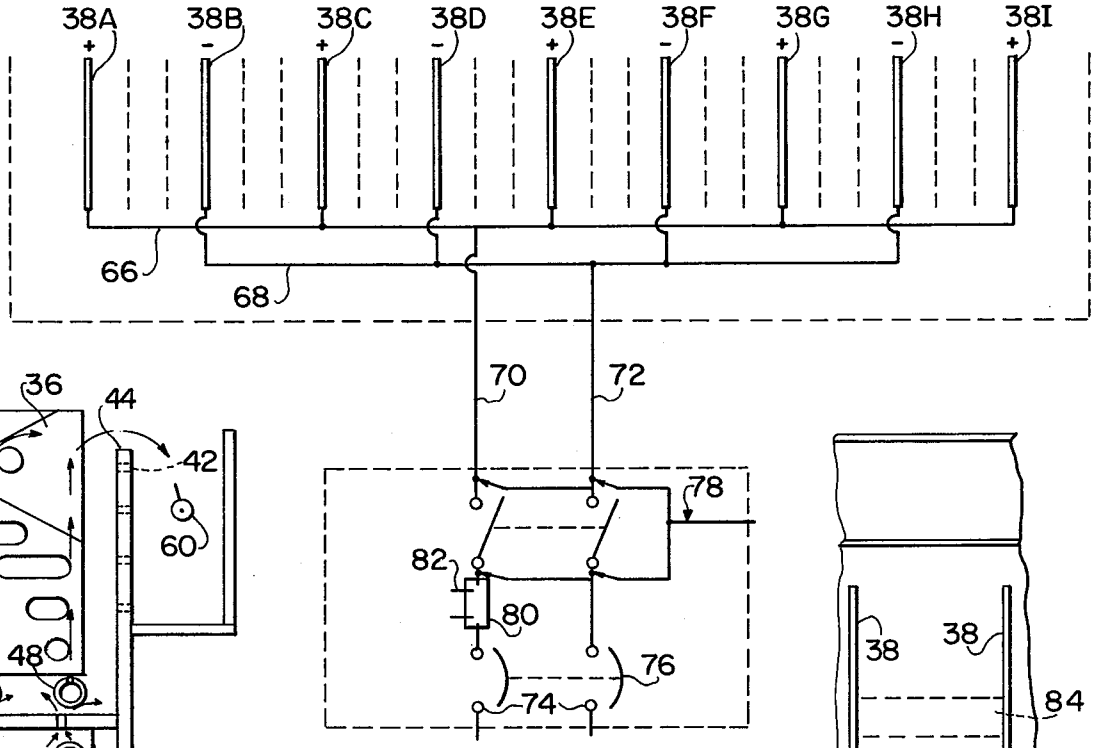

FIG. 3 is a schematic view of typical electrical connections as applied to a DC rheostat which can be utilized for general test purposes; and FIGS. 4*a* and 4*b* respectively are plan views to indicate how the dielectric barriers are utilized to controllably increase the current path length, FIG. 4*a* being directed to the mean electrical current path without barriers, and FIG. 4*b* relating to the use of the dieleectric barriers as positioned intermediate of electrode plates.

Referring now in more detail to the drawings the liquid rheostat system of the invention includes a base generally designated 10 consisting of longitudinal stringers 12 and cross members 14 mountably thereon. Adjustment means such as jacks or the like 16 are operatively associated with stringers 12 for leveling and/or adjustably disposing the water box and other structures therein, the water box being generally designated at 18. The water box 18 and rest of the apparatus or structure includes a main through 20 and, on the discharge end, a detachable through 22. The water box includes a false bottom 24 on a false bottom support 26. The detachable trough 22 is mounted on a through support shown at 28. Portions of a support cradle are shown at 30 placed at each end and side of the apparatus as shown. Within this above described structure are mounted a plurality of electrode plate supports 32 on opposite longitudinal sides of the apparatus and interspersed with a plurality of dielectric barrier supports shown at 34. A plurality of dielectric barriers 36 are mounted in the dielectric barrier supports and a plurality of interspersed electrode plates 38 are mounted in the electrode plate supports 32.

The plates have their bottom ends mounted on plate rests 40. A plurality of openings 42 arranged in rows and of different diameters are formed in side 44 of water box 18 as shown. The function of these will be explained hereinafter with respect to the weir system. The weir system is designed to function as follows:

When the customers's order specifies loading cycles that require that the height of electrolyte be held at some intermediate level (less than overflow) for a period of time under load, a sufficient flow of electrolyte through the rheostat to dissipate enough thermal to maintain electrolyte temperature within the design temperature rise limit must be provided. The plurality of openings 42 and the weir openings 89 at the discharge ends of the fixed trough 20 are designed such that the respective cumulative submerged areas of openings 42 and weir openings 89 are correctly proportioned to discharge the desired flow rate, set by fresh and brackish water valves, to maintain electrolyte temperature within the design limit.

Figure 1:
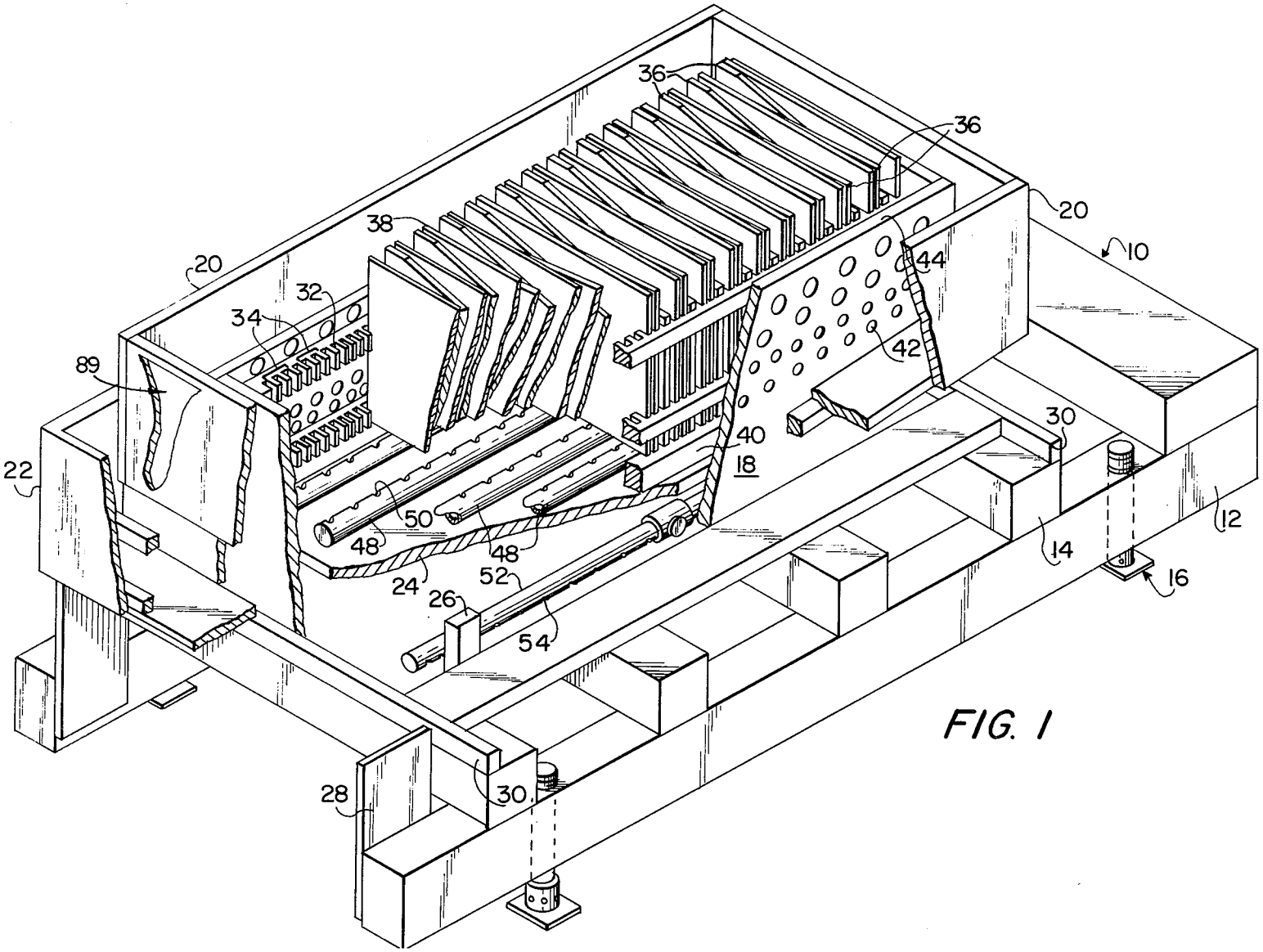
FIG. 1 is an isometric pictorial view of the apparatus in a DC configuration disclosing the overall construction and the inclusion and arrangement of plates, barriers and other portions thereof.

Fresh water piping shown at 48 having a plurality of openings 50 in the top thereof and salt water piping is shown at 52 having bottom openings 54 therein. The structure as shown in FIG. 1 and as above described, as hereinbefore pointed out discloses a DC configuration. Manifestly different types and arrangements of AC test apparatus can be utilized and from the description herein will be operatively apparently to those skilled in the art and no additional disclosure or showing thereof is considered as being necessary herein.

Figure 2:
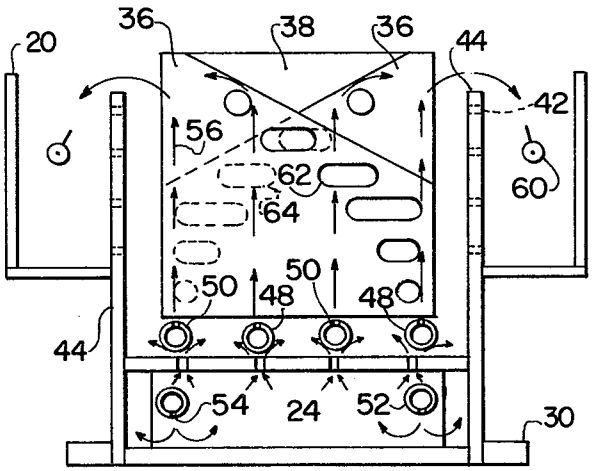
FIG. 2 is a transverse sectional view through the apparatus disclosing in more detail features of water circulation, arrangement of electrodes and dielectric barriers and additionally an incremental weir construction.

The transverse section shown in FIG. 2 further elaborates upon this structure explained in detail with respect to the apparatus. The pluralities of arrows proximate the fresh water and sea water inlets as also the arrows thereabove vertically directed as shown at 56 show the circulation of water. As indicated at 60 by circles the flow in the trough is toward the viewer. It will be seen that a plurality of openings 62 are included in the dielectric barriers and which can vary in shape and size for controlling length of electric current path. The second or rear barrier is also provided with similar openings as indicated at 64. It is to be noted that apertures 42 are only provided when a weir system is required as will be pointed out hereinafter. The configuration, arrangement and other details of the barriers and electrode plates will also be described in greater detail hereinafter.

In FIG. 3 there is shown a schematic of typical connections for a nine electrode rheostat, DC for general testing. The electrodes are designated 38A-38I inclusive with the position and negative portions being also indicated. The positive electrodes 38A, 38C, 38E, 38G and 38I are interconnected in line 66 of the circuit while electrodes 38B, 38D, 38F and 38H are interconnected to line 68 of the circuit with leads 70 and 72 being respectively interconnected with lines 66 and 68. Leads 74 are for interconnection with a machine or machine under test. A general circuit breaker is provided at 76 and lines generally indicated at 78 are provided for volt meter switch connection points and a shunt is utilized at 80 for connection to the ammeter by leads 82. By reference to the Schonhoff et al patent and details contained herein, operation of the test equipment and the circuit will be readily apparent. While the circuit is directed to a DC, nine electrode rheostat the device is capable of operation with AC circuits of different types including a desired number of electrodes with possible variation in the circuitry as desired. This particular aspect is not of the essence of the invention and will not be further disclosed herein.

FIGS. 4*a* and 4*b* are illustrative of how the barriers can increase the current path length as hereinabove and hereinafter referred to. In FIG. 4*a* the electrode plates are again indicated at 38 and as shown are spaced apart in the longitudinal direction of the rheostat apparatus. The mean electrical current path in the absence of electrode barriers is indicted by the dash lines at 84. FIG. 4*b* on the contrary shows the inclusion of dielectric barriers 36 between spaced electrode plates and with the openings 62, 64 being disclosed therein. The curvilinear path indicated by dash lines at 88 represents the mean electric current path using the barriers in accordance with the teaching of the invention. As pointed out hereinabove the present invention incorporates unique features which make it more readily adaptable for usage in an effective, relatively inexpensive and safe water rheostat which will be applicable in a larger range of water conditions than the apparatus as set forth in the preceding patent. The unique features of the present water rheostat reside in the continuous mixing of fresh water and harbor or brackish water in regulated proportions to obtain the desired resistivity of the electrolyte required to absorb the proper load and the regulation of flow of electrolyte through the rheostat to dissipate sufficient thermal energy, converted from electrical energy in the rheostat, to hold the temperature of the electrolyte within a certain desired range. The reason for this change and the objective of the redesign is to compensate for the variations in respective resistivity of fresh and/or brackish waters whereby to provide sufficient initial resistance as well as adequate range of control of resistance, whilw maintaining current density within the desired limits. Of substantial significance in the invention is the combination of shaping the electrode plates to increase the immeresed area thereof, with preselected disposition of the intermediate dielectric plates, shaped especially to decrease the length of the current path as the liquid level may be caused to rise.

OPERATION

The present rheostat may be operated as follows for a typical generator load test:

First, prior to closing a circuit breaker which places the rheostat across the armature terminals of the generator, sufficient fresh water is admitted to the enclosure to provide 10% of full load on the generator.

Secondly the circuit breaker is closed and the fresh water valves are set to obtain the desired rate of increase of liquid height. The raw or brackish water valves remain closed. The combined effect of decreasing current path length and increasing submerged electrode area as the liquid rises will decrease resistance gradually until the liquid reaches the normal depth and overflows into the trough. Should the test procedure require that the liquid level be held at some intermediate height for a period of time under load, a self regulating weir system is provided to permit a sufficient flow of liquid to dissipate the heat energy.

Third, increases the fresh water rate of flow to that rate required to dissipate the thermal energy converted at the ultimate generator load.

Fourth, slowly open the raw or brackish water valves to further reduce the resistivity of the electrolyte until the desired generator is reached.

The barriers achieve the desired purpose of increasing resistance and providing a more linear resistance characteristic. Electrode shaping, per se, may also be very effective, however, it must be undertaken with care so that current density does not reach the point where hot spots are formed.

Manifestly minor changes can be effected in the shown and described invention without departing from the spirit and scope thereof as defined in and limited solely be the appended claims.

We claim:

1. A method for dissipating an electric load in testing of generators and the like, including, in a liquid rheostat system the steps of: converting electrical energy output from the generators into thermal energy in a liquid rheostat by passing the electric current via pre-shaped electrode plates having increased area relative to depth of electrolyte through liquid constituting an electrolyte in the liquid rheostat, and dissipating the so-derived thermal energy comprising through a self adjustable weir system controlling flow and composition of the electrolyte through which the electric current is passed with the resultant conversion to thermal energy.

2. A method as claimed in claim 1, wherein the electrolyte consists of a combination of brackish and fresh waters, and continuously mixing the waters by controlling the flow of each into the liquid rheostat in regulated proportions to obtain the desired resistivity of the electrolyte required to absorb a proper load.

3. A method as claimed in claim 2, wherein the flow of electrolyte through the rheostat is so regulated as to dissipate sufficient thermal energy, converted from electrical energy in the rheostat to maintain the temperature of the electrolyte within a predetermined desired range.

4. A method as claimed in claim 3, wherein the electrolyte mixture is initially so controlled as to provide sufficient inititial resistance under conditions of variance of resistivity in the fresh and brackish waters available and utilized, and providing an adequate range of control of resistance and while concurrently keeping current density within desired limits.

5. A method as claimed in claim 4, wherein when the resistivity of available fresh water is very low, in a rheostat including a plurality of longitudinally spaced electrical electrode plates immersed in the electrolyte, installing intermediate plates of electric insulating material between the plates, and of a such configuaration and size, as to gradually decrease the length of the current path as the level of liquid in the rheostat rises.

6. A method as claimed in claim 5, wherein the shape of the electrode plates is selectively varied so that an immersed area thereof increases at a predetermined proper rate for optimum results as liquid level rises.

7. A method as claimed in claim 5, wherein initially, prior to electrically interconnecting output terminals of a generator to the rheostat, intorducing a small amount of fresh waters is into a rheostat electrolyte container sufficient to provide approximately ten per cent of full load on the generator, and after operative connection of the generator, setting the rate of fresh water introduction while discontinuing introduction of brackish water, decreasing the current path and increasing submerged electrode area as the liquid rises coupled with temperature rise of the electrolyte, with a resultant gradual resistance decrease until the liquid reaches a normal depth and overflows.

8. A method as claimed in claim 7, and increasing fresh water rate of flow to appropriately dissipate thermal energy of the ultimate generator load.

9. A method as claimed in claim 8, and slowly increasing introduction of brackish water to further reduce resistance of the electrolyte until desired load dissipation is reached.

10. In a system for dissipating an electric load in testing of generators in testing generating plants and the like. a liquid rheostat system including:

a. a liquid electrolyte container;

b. means for controllably introducing an electrolyte liquid consisting of a mixture of fresh and brackish water into said container;

c. a plurality of electrode plates immersed in said electrolyte liquid, d. a plurality of dielectric barries selectively interposed between said electrode plates; and e. an electric circuit interconnecting a said generator load and the liquid rheostat to pass electric current in a path through said rheostat.

11. The system of claim 10, wherein said electrode plates and said dielectric barriers are alternate in disposition.

12. The system of claim 11, wherein said dielectric barriers consist of intermediate plates of electrical insulating material and so shaped as to, in assembled relationship, decrease the effective length of said current path as the level of liquid electrolyte in said container rises.

13. The system of claim 13, wherein said electrode plates are so shaped tht the immersed area thereof increases at a desired appropriate rate as liquid level in the container rises.

14. The system of claim 13, and further including additional means of regulating load consisting of a regulating weir system for controlling flow rate and level of electrolyte in the container.

15. The system of claim 14, wherein said barrier plates are so constructed and shaped as to gradually decrease the length of the current path through the electrolyte as level in the container rises.

* * * * *